US007584915B2

(12) United States Patent
Jara-Almonte et al.

(10) Patent No.: US 7,584,915 B2
(45) Date of Patent: Sep. 8, 2009

(54) FOOD WASTE DISPOSER ANTIVIBRATION SYSTEM

(75) Inventors: Cynthia C Jara-Almonte, Kenosha, WI (US); Steven P Hanson, Racine, WI (US); Scott Anderson, Racine, WI (US); Thomas R Berger, Racine, WI (US)

(73) Assignee: Emerson Electric Co., St. Louis, MO (US)

( * ) Notice: Subject to any disclaimer, the term of this patent is extended or adjusted under 35 U.S.C. 154(b) by 722 days.

(21) Appl. No.: 11/164,013

(22) Filed: Nov. 7, 2005

(65) Prior Publication Data

US 2006/0097091 A1 May 11, 2006

Related U.S. Application Data

(60) Provisional application No. 60/625,258, filed on Nov. 5, 2004.

(51) Int. Cl.
*B02C 23/36* (2006.01)

(52) U.S. Cl. ..... 241/46.016; 241/46.014; 241/46.015

(58) Field of Classification Search ..... 241/46.013–46.016; 181/198, 284–294
See application file for complete search history.

(56) References Cited

U.S. PATENT DOCUMENTS

| | | | | |
|---|---|---|---|---|
| 2,743,875 | A | 5/1956 | Brezosky et al. | |
| 2,828,084 | A | 3/1958 | Lewis et al. | |
| 2,894,698 | A | 7/1959 | Brucken | |
| 2,945,635 | A | 7/1960 | Jordan | |
| 2,949,246 | A | 8/1960 | Hyde | |
| 2,951,650 | A | 9/1960 | Gould | |
| 2,965,317 | A | 12/1960 | Jacobs | |
| 2,965,318 | A * | 12/1960 | Jordan | 241/46.014 |
| 2,975,986 | A | 3/1961 | Frank | |
| 3,684,199 | A | 8/1972 | Bebinger | |
| 3,801,998 | A | 4/1974 | Macias | |
| 3,862,720 | A * | 1/1975 | Guth | 241/46.015 |
| 3,982,703 | A | 9/1976 | Meyers | |

(Continued)

FOREIGN PATENT DOCUMENTS

| | | |
|---|---|---|
| JP | 11-090688 A | 10/2000 |

(Continued)

OTHER PUBLICATIONS

PCT International Search Report for Corresponding International Application No. PCT/US2005/040440, filed Nov. 7, 2005 (5 pages).

(Continued)

*Primary Examiner*—Jimmy T Nguyen
(74) *Attorney, Agent, or Firm*—Harness, Dickey & Pierce, P.L.C.

(57) ABSTRACT

A food waste disposer includes a housing defining an inlet opening and a grinding mechanism driven by a motor for grinding food waste received into the housing through the inlet opening. An annular retaining collar has one end for connecting to a sink opening, via a standard sink mount, for example. An annular elastomeric coupler is situated about the opposite end of the annular retaining collar and connected to the housing for vibrationally isolating the annular retaining collar from the housing. The primary loading on the elastomeric material is in shear. Elastomeric materials in shear are particularly effective in absorbing both vibration and shock loads.

20 Claims, 4 Drawing Sheets

U.S. PATENT DOCUMENTS

| | | | | |
|---|---|---|---|---|
| 4,310,933 | A | 1/1982 | Stratman | |
| 5,409,993 | A * | 4/1995 | Kojima et al. | 525/104 |
| 5,894,869 | A * | 4/1999 | Mussack | 141/19 |
| 5,924,261 | A * | 7/1999 | Fricke | 52/831 |
| 5,924,635 | A * | 7/1999 | Koshimizu et al. | 241/46.015 |
| 6,007,006 | A | 12/1999 | Engel et al. | |
| 6,481,652 | B2 | 11/2002 | Strutz et al. | |
| 6,719,228 | B2 | 4/2004 | Berger et al. | |
| 6,772,968 | B2 | 8/2004 | Jara-Almonte et al. | |
| 6,854,673 | B2 | 2/2005 | Strutz et al. | |
| 2002/0104908 | A1 * | 8/2002 | Berger et al. | 241/21 |
| 2004/0195409 | A1 | 10/2004 | Berger et al. | |

FOREIGN PATENT DOCUMENTS

| | | | |
|---|---|---|---|
| JP | 2002-082957 | A | 9/2003 |
| JP | 2002-225558 | A | 3/2004 |

OTHER PUBLICATIONS

PCT Written Opinion of the International Searching Authority for Corresponding International Application No. PCT/US2005/040440, filed Nov. 7, 2005 (5 pages).

* cited by examiner

FOOD WASTE DISPOSER ANTIVIBRATION SYSTEM

CROSS REFERENCE TO RELATED APPLICATION

The present application claims priority to U.S. Provisional Patent Application Ser. No. 60/625,258 filed Nov. 5, 2004, the contents of all of which are incorporated herein by reference.

BACKGROUND

The present disclosure relates generally to food waste disposers, and more specifically, to a vibration isolation mount system for a food waste disposer.

Known domestic food waste disposers typically are rigidly coupled to a sink flange through a highly compressed rubber-mounting gasket. This gasket serves as the primary seal between the sink and the disposer and thus, must be highly compressed to ensure that no leakage occurs during operation. The disposer itself is inherently a vibration source both from the motor operation and from the impacts of food waste against the grind mechanism and the housing. These two sources result in a broad frequency spectrum vibration that is transmitted into the sink, countertop, and cabinet through the connection of the disposer with the sink. While the vibration itself may be annoying, it is also a source of structural noise that can be quite objectionable. This is particularly evident in installations with relatively thin stainless steel sinks, which are excellent resonators The noise produced by food waste disposers during the course of normal operation is often caused by operation of the motor in combination with the impacting of food waste against the housing of the disposer. Consequently, and in response to these concerns, a number of approaches to the problems of vibration-associated noise in conjunction with normal food waste disposer operation have been attempted.

A flexible coupling between the disposer and the sink can reduce the transmission of the vibration from the disposer into the sink, countertop, cabinet walls and pipes. This in turn can result in noticeable noise reduction. Prior vibration isolation mounts have typically used rubber couplings in conjunction with mechanical means, such as springs. However, not only do these mounts change the plumbing dimensions, but the added components make the installation of the disposer more difficult. Further, the use of rubber in a tension environment can result in the accelerated degradation of the rubber over time, due to creep as well as chemical and aging effects.

Thus, there exists a need for an anti-vibration mount for use in association with a food waste disposer that reduces vibration and associated noise of the food waste disposer during the course of normal operation, retains the original plumbing profile of the food waste disposer, and allows for simple installation.

SUMMARY

In accordance with certain aspects of the present application, a vibration isolation system for a food waste disposer is disclosed. The food waste disposer includes a housing defining an inlet opening and a grinding mechanism driven by a motor for grinding food waste received into the housing through the inlet opening. An annular retaining collar has first and second ends. The first end is adjacent the inlet opening and the second end connects to a sink opening, via a standard sink mount, for example. In some embodiments, the first end is received in the inlet opening. An annular elastomeric coupler is situated about the first end of the annular retaining collar and is connected to the housing for vibrationally isolating the annular retaining collar from the housing. The primary loading on the elastomeric material is in shear. Elastomeric materials in shear are particularly effective in absorbing both vibration and shock loads.

In certain exemplary embodiments, the annular elastomeric coupler is positioned inside the housing. In other words, the coupler is below the top cover of the housing and does not extend outside of the housing, minimizing the necessity for plumbing changes as compared to disposers without the disclosed anti-vibration system. In further embodiments, an annular connection member is connected to the housing and surrounds the annular elastomeric coupler such that the annular elastomeric coupler is between the annular retaining collar and the annular connection member.

BRIEF DESCRIPTION OF THE DRAWINGS

The following figures form part of the present specification and are included to further demonstrate certain aspects of the present invention. The invention may be better understood by reference to one or more of these figures in combination with the detailed description of specific embodiments presented herein.

Figure 1:
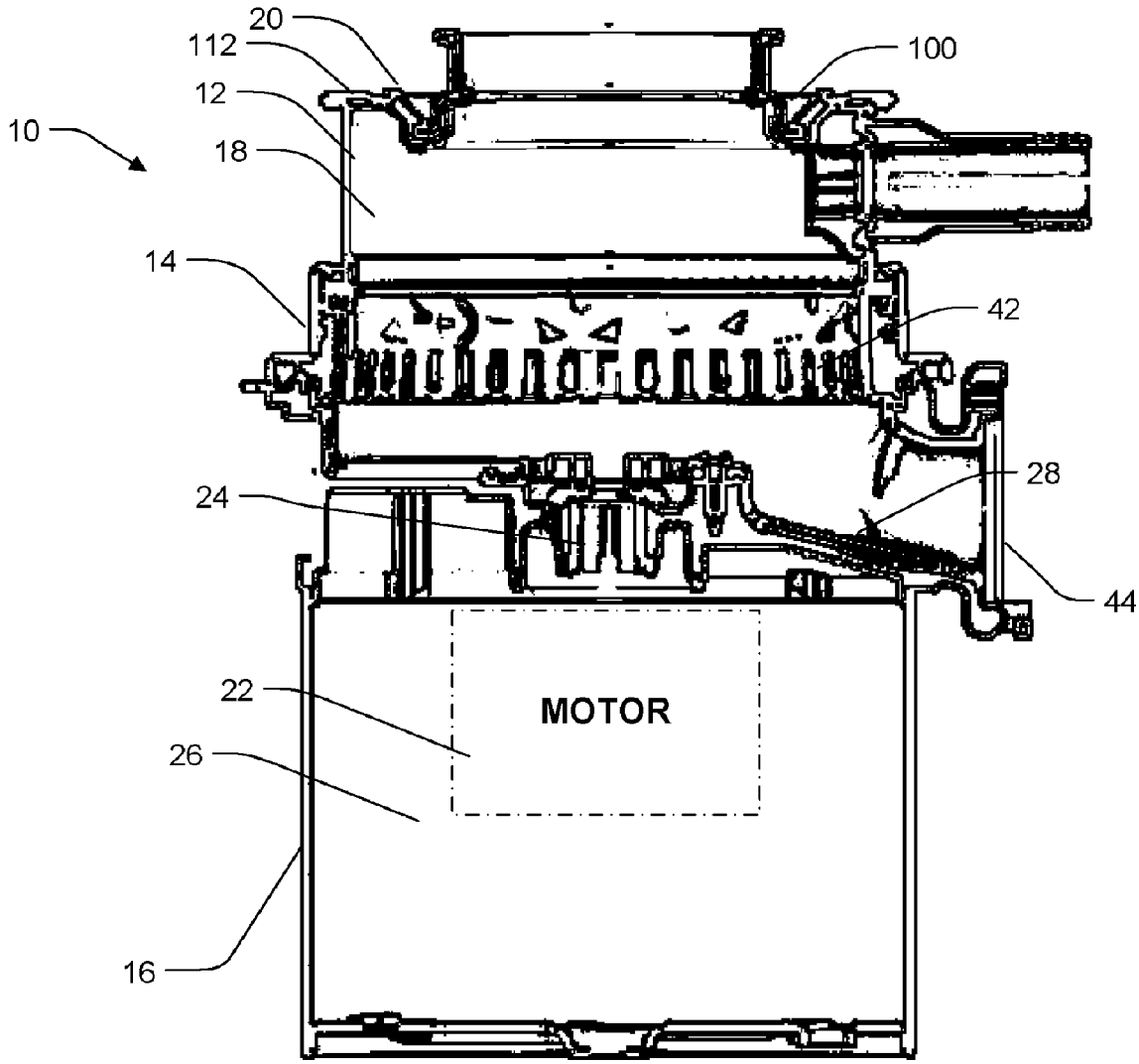
FIG. 1 illustrates a partial cross-sectional view of a food waste disposer in accordance with an aspect of the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention.

DETAILED DESCRIPTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Turning to the figures, FIG. 1 illustrates an exemplary food waste disposer in accordance with aspects of the present disclosure. The disposer 10 includes an upper food conveying section 12, a lower motor section 16, and a central grinding section 14 disposed between the food conveying section 12 and the motor section 16. The food conveying section 12 includes a housing 18 having a top cover 112 defining an inlet opening 20 therethrough. The housing 18 and top cover 112 are made of stainless steel in exemplary embodiments. A vibration isolation, or "anti-vibration," mounting system 100 is received by the inlet opening 20. The food conveying section 12 conveys the food waste to the central grinding section 14. The motor section 16 includes a motor 22 imparting rotational movement to a motor shaft 24. The motor 22 is enclosed within a motor housing 26. The grinding section 14 includes a grinding mechanism having lugs, a rotating plate, and a stationary shredder ring.

In operation, the food waste delivered to the grinding section by the food conveying section 12 is forced by the grinding lugs against teeth 42 of the shredder ring. The edges of teeth 42 grind the food waste into particulate matter sufficiently small so as to pass from the space above the grind plate to the space below the grind plate via gaps between the teeth 42 outside the periphery of the plate. Due to both gravity and water flow, the particulate matter that passes through the gaps between teeth 42 drops onto base frame 28 and, along with water injected into the disposer via the faucet associated with the sink, is discharged through a discharge outlet 44.

Figure 2:
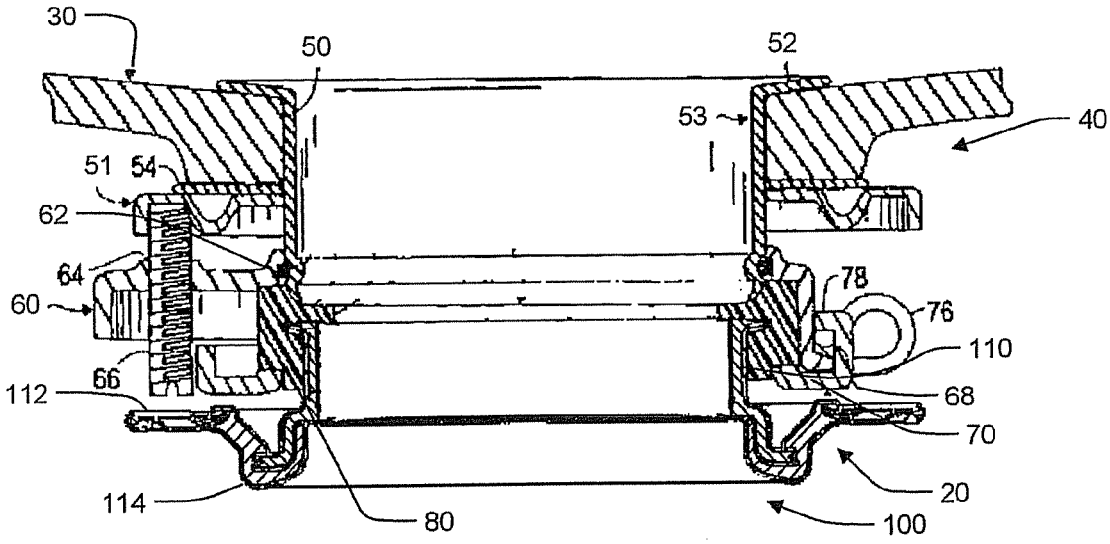
FIG. 2 illustrates a detailed cross-sectional view of an aspect of an anti-vibration system in accordance with the present invention.

FIG. 2 is a detailed view of the upper sections of the food waste disposer illustrated in FIG. 1. As shown in FIG. 2, and in accordance with conventional food waste disposers, a sink mounting assembly 40 includes a sink collar 53, a backup flange 51, a mounting flange 60, and a support flange 70. Sink collar 53 is positioned within drain opening 50 of sink 30, leaving drain flange 52 to rest around the drain opening 50 as shown. During typical assembly, a fiber washer 54 and the backup flange 51 are slipped onto the sink collar 53 which extends through sink 30 and extends below the underside of sink 30. The mounting flange 60 is then slipped onto the collar 53, and a snap ring 62 is seated within an annular recess on the sink collar 53. Studs 66 are then threaded through holes 64 in the mounting flange 60 until they contact the underside of a projecting surface of the backup flange 51, thus pressing the fiber washer 54 between the backup flange 51 and the sink 30. While not shown in the figures herein, three or more studs 66 are typically used, but only one is illustrated for the sake of clarity in the cross-sectional view. The mounting flange 60 has inclined flanges 68 onto which the remainder of the disposer, and the anti-vibration mounting assembly 100, can be attached to affix the disposer into position underneath the sink. This will be explained in further detail below.

Figure 3:
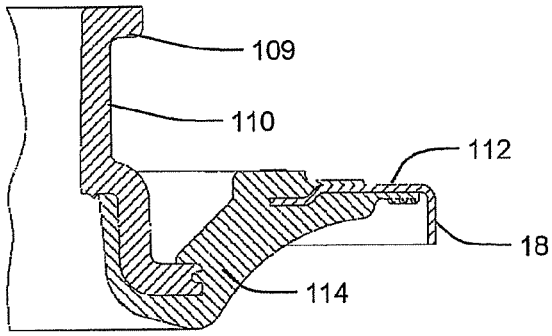
FIG. 3 illustrates a sectional, cross-sectional view of portions of the anti-vibration system of FIG. 2.

FIG. 3 illustrates the anti-vibration mounting assembly 100 of FIG. 2 in more detail. As shown therein, mounting assembly 100 includes an annular retaining collar 110 with its lower part positioned in the inlet opening 20 of the top cover 112 such that a portion of the lower part of the collar 110 is within the housing 18. The upper portion of the collar 110 includes an outwardly extending lip 109, and extends upwardly from the top cover 112 for connection to the sink mounting assembly 40. An annular elastomeric coupler 114 is situated about the lower portion of the annular retaining collar 110 and is connected to the top cover 112 of the housing 18.

The elastomeric coupler 114 absorbs vibrations generated by the disposer 10, isolating the collar 110, and in turn the mounting assembly 40 and sink, from the vibrations generated by the disposer 10. As such, the elastomeric coupler 114 provides the connection between the retaining collar 110 and the top cover 112 of the housing 18. In certain embodiments, the assembly is insert molded, wherein the collar 110 and the top container covering 112, are inserted into a mold and the elastomeric material is molded around them to form the coupler 114. The retaining collar 110 is made of any suitably rigid material, such as glass-filled nylon, plastic or stainless steel. Suitable materials for the elastomeric coupler 114 include halobutyl rubber (e.g., chlorobutyl rubber (CIIR)) or nitrile rubber (e.g., NBR).

Returning now to the assembly referenced in detail in FIG. 2, with the anti-vibration mount assembly 100 affixed to the housing 18 of the food waste disposer via the elastomeric coupler 114 molded or otherwise affixed to the top covering 112 of the food waste disposer housing 18, the disposer can be affixed to the mounting flange 60 already supported under the sink, as described above. The support flange 70 is positioned on the collar 110 of the assembly 100, and a mounting gasket 80 is press fit onto the outwardly extending lip 109 of the collar 110 to hold the support flange 70 in place. As shown, the support flange 70 contains inwardly bent tabs 78.

When the disposer and anti-vibration mount assembly 100 (with the support flange 70 in place) is to be affixed to the mounting flange 60 (already supported under the sink 30 ), the tabs 78 are positioned so as to meet with the inclining flanges 68 on the mounting flange 60. As a result of inclining flanges 68 being inclined, the tabs 78 can be twisted with respect to the flanges 68, thereby screwing the disposer onto the mounting flange 60 so as to position the disposer in place beneath sink 30. To facilitate turning the support flange 70, the support flange 70 is preferably formed with finger pads 76 (only one is shown for reasons of clarity). As the support flange 70 is twisted into place, it is brought closer to the mounting flange 60 due to the incline flanges 68, thereby compressing the mounting gasket 80.

As shown in FIGS. 1 and 2, the connection between the elastomeric coupler 114 and the collar 110 is actually situated inside the container body 18—it does not substantially extend beyond the top cover 112. In the illustrated embodiment, the primary loading on the elastomeric material is in shear. Elastomeric materials in shear are particularly effective in absorbing both vibration and shock loads. The compressive load upon the material due to the weight of the disposer is low and avoids the undesirable stiffening of the material that can occur under high compression.

By situating the elastomeric coupler 114 into the container body, the overall height of the unit doesn't change in comparison to units without such an anti-vibration mount. Having the same height as existing disposers eliminates plumbing rework required in replacement installations.

A rubber coupler in tension between the mounting assembly and container body may be somewhat effective in reducing vibration transmission and the accompanying noise. However, rubber in tension may suffer degradation over time due to creep as well as chemical and aging effects. Thus it is desirable to isolate the disposer from the sink using elastomeric material in either compression or shear.

The anti-vibration mount assembly 100 disclosed herein absorbs vibration and shock loads through shear loading of elastomeric material and is effective at reducing vibration transmission. In the illustrated embodiment, the primary load path for the shock loads and vibration absorption is through shearing of the elastomeric material. Moreover, the construction is such that even if the elastomeric coupler were to fail due to long term chemical and aging effects, the disposer would remain functional.

Figure 4:
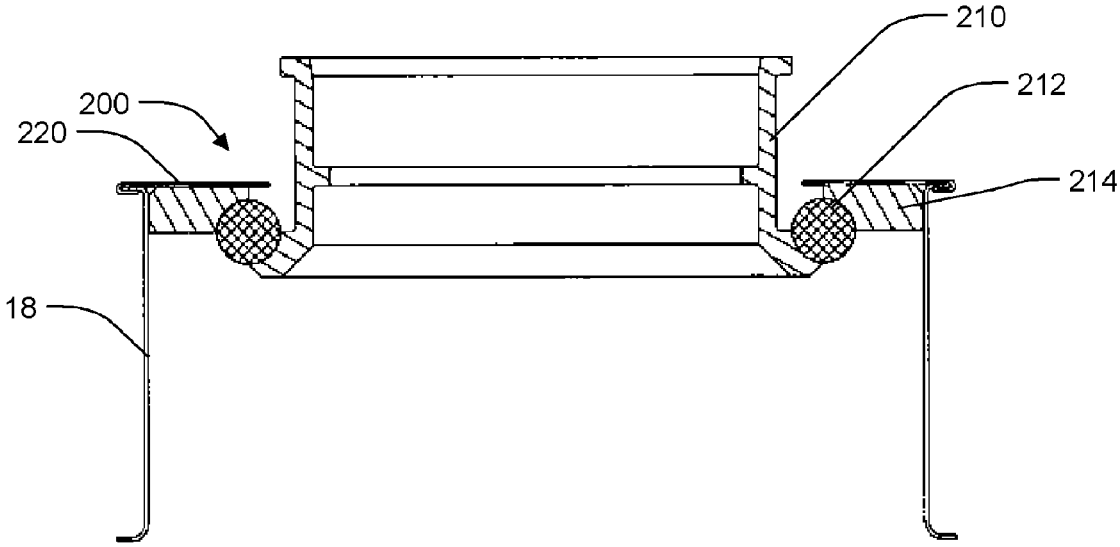
FIG. 4 illustrates a detailed cross-sectional view of an alternative anti-vibration system in accordance with an aspect of the present invention.

Referring to FIG. 4, another embodiment of an anti-vibration mounting assembly 200 for a food waste disposer is illustrated in partial cross-sectional view. Similar to the aspects described above, the anti-vibration mounting assembly 200 is molded onto a portion of the disposer's housing, and is preferably mounted onto a top container cover 220 of the housing 18 of the disposer. More specifically, assembly 200 includes an annular retaining collar 210, an annular connection member 214 connected to the top cover 220, and annular elastomeric coupler 212. The coupler 212 illustrated defines a generally circular cross-section, though other cross-sectional shapes could be used, such as a polygon-shaped cross-section.

Figure 5:
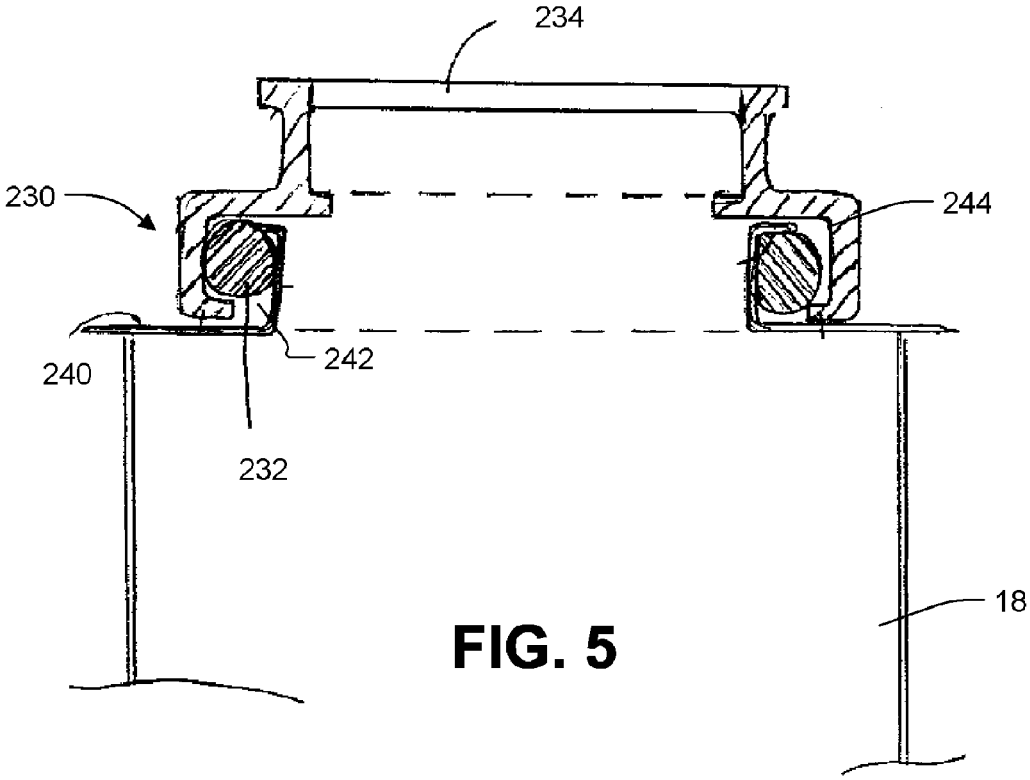
FIG. 5 illustrates a detailed cross-sectional view of a further anti-vibration system in accordance with an aspect of the present invention.

Turning now to FIG. 5, another alternative embodiment is shown. Herein, anti-vibration mounting assembly 230 comprises a collar 234 and an elastomeric coupler 232. Assembly 230 further comprises top container covering 240 that forms a first internal recess 242. The collar 234 defines a second internal recess 244. The coupler 232 fits within the containment area formed by the first and second internal recesses 242,244 as shown in FIG. 5. As described previously, coupler 232 can be made of any suitable elastomeric material. As illustrated, the coupler 232 defines a generally circular cross-section, though other shapes could be used.

Figure 6:
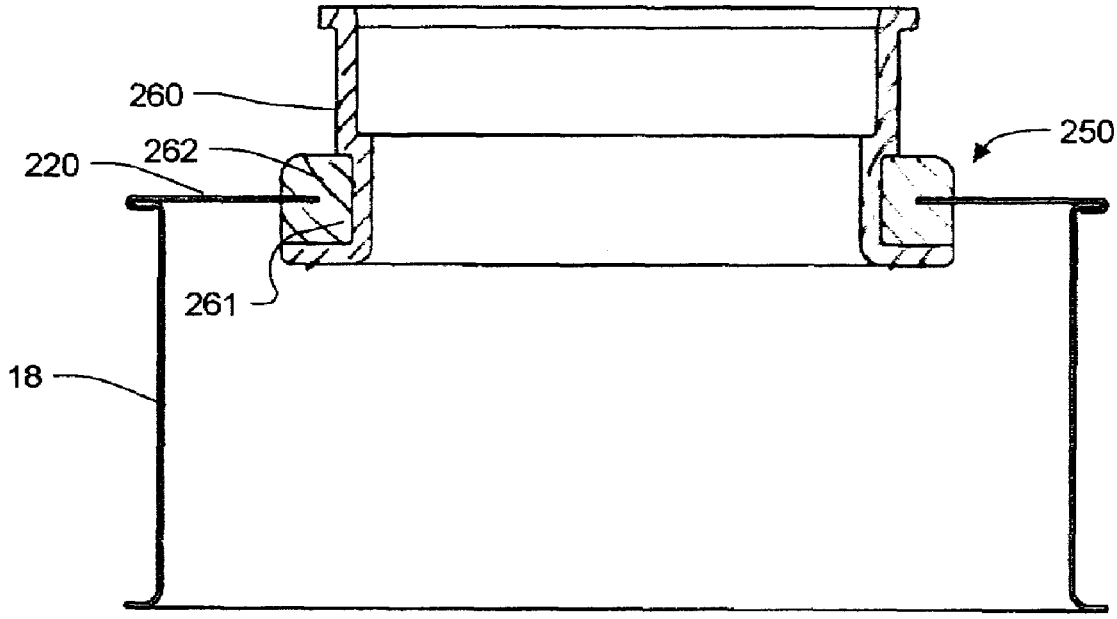
FIG. 6 illustrates a detailed cross-sectional view of another alternative anti-vibration system in accordance with an aspect of the present invention.

FIG. 6 illustrates another aspect of the present invention, showing an anti-vibration mounting assembly 250 comprising an annular retaining collar 260 and an annular, elastomeric coupler 262. Annular collar 260 defines an annular recess 261, and the elastomeric coupler 262 is mounted within recess 261 of mounting collar 260. Elastomeric coupler 262 is further attached to top container cover 220 . The elastomeric coupler 262 can be molded onto the top cover 220, for example. Elastomeric coupler 262 has a polygon cross-section as can be seen in FIG. 6.

The invention has been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, the Applicants intend to protect all such modifications and improvements to the full extent that such falls within the scope or range of equivalent of the following claims.

What is claimed is:

1. A food waste disposer, comprising:

a housing defining an inlet opening, a grinding mechanism driven by a motor for grinding food waste received into the housing through the inlet opening;

an annular retaining collar having lower and upper ends, the upper end for connecting to a sink collar in a sink opening by a mounting flange;

and an annular elastomeric coupler having a first portion situated about the lower end of the annular retaining collar and a second portion connected to the housing for vibrationally isolating the annular retaining collar from the housing wherein the lower end of the annular retaining collar extends into the housing below where the second portion of the annular elastomeric coupler connects to the housing, the annular elastomeric coupler extending upwardly and outwardly from the lower end of the annular retaining collar to the housing so that loading on the elastomeric coupler is shear.

2. The food waste disposer of claim 1, wherein the annular elastomeric coupler is positioned inside the housing.

3. The food waste disposer of claim 1, further comprising an annular connection member connected between the housing and the annular elastomeric coupler.

4. The food waste disposer of claim 1, wherein the housing defines a recess receiving the annular elastomeric coupler.

5. The food waste disposer of claim 1, wherein the lower end of the annular retaining collar defines a recess receiving the annular elastomeric coupler.

6. The food waste disposer of claim 1, wherein the annular elastomeric coupler defines a substantially circular cross-section.

7. The food waste disposer of claim 1, wherein the annular elastomeric coupler defines a polygon-shaped cross-section.

8. The food waste disposer of claim 1, wherein the annular elastomeric coupler is comprised of an elastomer selected from the group consisting of halobutyl rubbers, nitrile rubbers, and combinations thereof.

9. The food waste disposer of claim 1, wherein the annular retaining collar is made of glass-filled nylon.

10. The food waste disposer of claim 1, wherein the annular retaining collar is made of plastic.

11. The food waste disposer of claim 1, wherein the annular retaining collar is made of stainless steel.

12. An anti-vibration system for a food waste disposer, the food waste disposer including a housing defining an inlet opening a grinding mechanism driven by a motor for grinding food waste received into the housing through the inlet opening, the anti-vibration system comprising:

an annular retaining collar having lower and upper ends, the lower end receivable in the inlet opening, and the upper end for connecting to a sink collar in a sink opening by a mounting flange;

and an annular elastomeric coupler having a first portion situated about the lower end of the annular retaining collar and a second portion connectable to the housing for vibrationally isolating the annular retaining collar from the housing wherein the lower end of the annular retaining collar extends into the housing below where the second portion of the annular elastomeric coupler connects to the housing, the annular elastomeric coupler extending upwardly and outwardly from the lower end of the annular retaining collar to the housing so that loading on the elastomeric coupler is shear.

13. The anti-vibration system of claim 12, further comprising an annular connection member surrounding the annular elastomeric coupler such that the annular elastomeric coupler is between the annular retaining collar and the annular connection member.

14. The anti-vibration system of claim 12, wherein the annular elastomeric coupler defines a substantially circular cross-section.

15. The anti-vibration system of claim 12, wherein the annular elastomeric coupler defines a substantially polygon-shaped cross-section.

16. The anti-vibration system of claim 12, wherein the annular elastomeric coupler is comprised of an elastomer selected from the group consisting of halobutyl rubbers, nitrile rubbers, and combinations thereof.

17. The anti-vibration system of claim 12, wherein the annular retaining collar is made of glass-filled nylon.

18. The anti-vibration system of claim 12, wherein the annular retaining collar is made of plastic.

19. The anti-vibration system of claim 12, wherein the annular retaining collar is made of stainless steel.

20. The anti-vibration system of claim 12, wherein the lower end of the annular retaining collar defines a recess receiving the annular elastomeric coupler.

* * * * *

UNITED STATES PATENT AND TRADEMARK OFFICE

CERTIFICATE OF CORRECTION

PATENT NO. : 7,584,915 B2
APPLICATION NO. : 11/164013
DATED : September 8, 2009
INVENTOR(S) : Jara-Almonte et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 975 days.

Signed and Sealed this

Fourteenth Day of September, 2010

David J. Kappos

David J. Kappos
*Director of the United States Patent and Trademark Office*